US008906450B1

(12) United States Patent
McInerney et al.

(10) Patent No.: US 8,906,450 B1
(45) Date of Patent: Dec. 9, 2014

(54) COLD SPRAY SYSTEM NOZZLE

(75) Inventors: Edward J. McInerney, San Jose, CA (US); Johannes Vlcek, San Francisco, CA (US)

(73) Assignee: Hanergy Holding Group Ltd., Beijing (CN)

( * ) Notice: Subject to any disclaimer, the term of this patent is extended or adjusted under 35 U.S.C. 154(b) by 181 days.

(21) Appl. No.: 13/247,187

(22) Filed: Sep. 28, 2011

(51) Int. Cl.
*B05D 1/12* (2006.01)
*C23C 24/04* (2006.01)

(52) U.S. Cl.
USPC ..... 427/190; 427/191; 427/427

(58) Field of Classification Search
USPC ..... 427/190, 191, 427
See application file for complete search history.

(56) References Cited

U.S. PATENT DOCUMENTS

| | | | | |
|---|---|---|---|---|
| 6,502,767 | B2 | 1/2003 | Kay et al. | |
| 6,722,584 | B2 | 4/2004 | Kay et al. | |
| 7,637,441 | B2 * | 12/2009 | Heinrich et al. | 239/135 |
| 2002/0033135 | A1 | 3/2002 | Kay et al. | |
| 2003/0219542 | A1 * | 11/2003 | Ewasyshyn et al. | 427/421 |
| 2008/0271779 | A1 * | 11/2008 | Miller et al. | 136/252 |
| 2010/0136242 | A1 | 6/2010 | Kay et al. | |
| 2010/0143700 | A1 * | 6/2010 | Champagne et al. | 428/323 |

OTHER PUBLICATIONS

U.S. Appl. No. 12/907,169, filed Oct. 19, 2010.
Irissou, Eric et al., "Review on Cold Spray Process and Technology: Part I—Intellectual Property", J. of Thermal Spray Tech., vol. 17(4), pp. 495-516, Dec. 2008.

* cited by examiner

*Primary Examiner* — Frederick Parker
(74) *Attorney, Agent, or Firm* — The Marbury Law Group PLLC

(57) ABSTRACT

A powder spray nozzle includes an inlet portion having an inlet diameter and an inlet length and an outlet portion having outlet diameter and an outlet length. The nozzle also includes an interface region between the inlet portion and the outlet portion having an interface diameter. A ratio of the inlet diameter to the inlet length is in a range of about 0.15 to 0.5.

14 Claims, 7 Drawing Sheets

COLD SPRAY SYSTEM NOZZLE

BACKGROUND

Cold spray is used to inject microscopic powdered particles of metal or other solids into a supersonic jet of rapidly expanding gas and shooting them at a target surface. The solids ejecting from the spray exit so fast that when they come into contact with the target surface they stick to and coat the surface.

Technological advances in cold spray technology have rendered it useful in many different industries, such as the automotive and airplane manufacturing. For example, cold spray is used in the automotive industry to create a tough coating on car engine components made from lighter-weight composites, or to deposit layers of conductive metals onto substrates for use as heat-tolerant under-hood automobile electronics. However, still many problems are encountered in employing cold spray technology. For example, one problem in the cold spray process is powder residue build up in the cold spray nozzle during use. The rate of residue formation may be so high as to impact the throughput and cost-effectiveness of cold spraying as a substrate coating technique.

SUMMARY

An embodiment relates to a powder spray nozzle including an inlet portion having an inlet diameter and an inlet length and an outlet portion having outlet diameter and an outlet length. The nozzle also includes an interface region between the inlet portion and the outlet portion having an interface diameter. A ratio of the inlet diameter to the inlet length is a range of about 0.15 to 0.5.

Another embodiment relates to a method of using a powder spray nozzle. The method includes spraying a powder onto a substrate through a nozzle. The nozzle includes an inlet portion having an inlet diameter and an inlet length and an outlet portion having outlet diameter and an outlet length. The nozzle also includes an interface region between the inlet portion and the outlet portion having an interface diameter. A ratio of the inlet diameter to the inlet length is a range of about 0.15 to 0.5.

BRIEF DESCRIPTION OF THE DRAWINGS

The accompanying drawings, which are incorporated herein and constitute part of this specification, illustrate exemplary aspects of the invention, and together with the general description given above and the detailed description given below, serve to explain the features of the invention.

DETAILED DESCRIPTION

Figure 1:
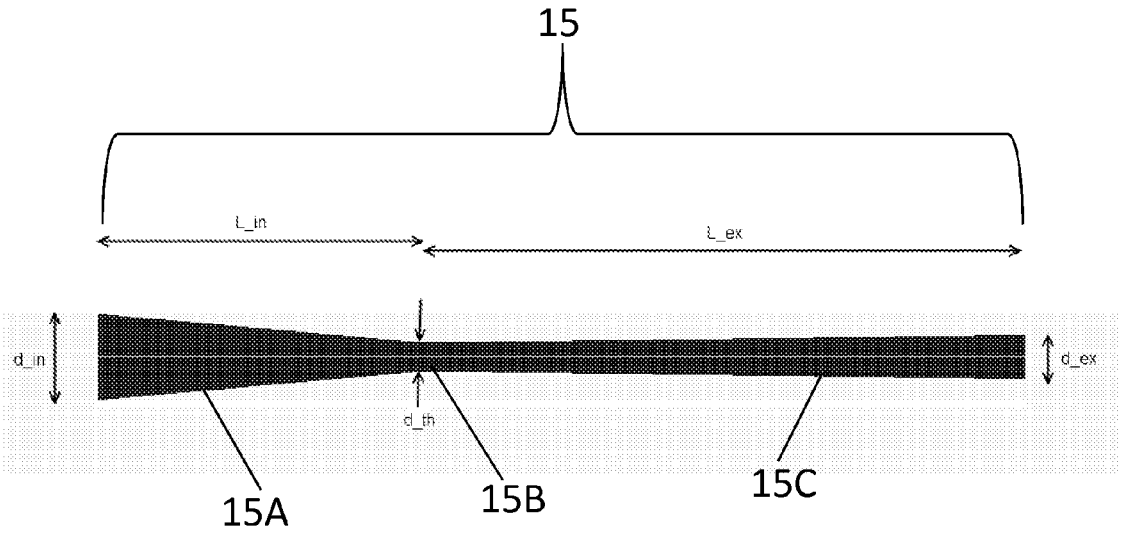
FIG. 1 is a schematic illustration of a cold spray nozzle according to an embodiment.

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims.

The word "exemplary" is used herein to mean "serving as an example, instance, or illustration." Any implementation described herein as "exemplary" is not necessarily to be construed as preferred or advantageous over other implementations.

The terms "kinetic spray" or "cold spray" process are used interchangeably herein. Thus, the term "cold spray" includes within its scope supersonic cold spray, sonic cold spray and subsonic cold or kinetic spray (also known as kinetic metallization). The cold spray process involves directing a powder loaded gas stream towards a "substrate," such as a sputtering target backing structure to produce a deposit entirely built up from the powder material without significantly melting the powder or otherwise coarsening the powder microstructure. In other words, the metal (or metal alloy) powder particles preferably remain in the solid state throughout the process from the time the particles are provided into the injection nozzle to the time the particles reach the backing structure. As the powder particles exit the nozzle at a high velocity, they collide with and form a deposited layer on the backing structure.

U.S. Pat. No. 6,722,584, incorporated herein by reference in its entirety, illustrates an exemplary prior art cold spray system. Exemplary high and low pressure cold spray systems which use a supersonic gas stream are available from Centerline of Windsor, Canada (low pressure system) and CGT of Ampfing, Germany (high pressure system). The differences between the two systems are the system pressure, the injection point of the powder particles and the feeding system. High pressure cold spray systems generally operate at a pressure of 2.5 to 4.5 MPa (i.e., 25 to 45 bar), while low pressure systems generally operate at a pressure of 0.4 to 1.03 MPa (i.e., 4 to 10.3 bar). In general, in high pressure systems, powder particles are feed at the nozzle centerline before the nozzle throat section, while in low pressure systems, the powder is injected radially after the throat section. The feeding systems of each cold spray system are based on the largely different system pressures and usually require a high pressure feeding system for the high pressure process.

A third type of cold spray process, which is often called kinetic metallization or kinetic spray differs from the high and low pressure supersonic cold spray systems in that it uses a subsonic process gas velocity and a subsonic gas nozzle. An exemplary kinetic spray is available from Inovati of Santa Barbara, USA. The exemplary system available from Inovati may also contain a split path for the helium process gas (where the cold helium leg is routed through the powder fluidizing unit while the hot leg is routed through the thermal conditioning unit (e.g., heater), followed by merging both legs of the process gas in a mixing chamber), triboelectric charging of the metal particles, and fluid dynamically coupled debris recovery nozzles.

Cold spray powder deposition requires a minimum or so called "critical" powder particle velocity in order to achieve particle bonding and material built up. Depending on the material, a deposit will form when the particles reach a critical velocity for bonding of the particular material. The critical velocity is often defined as the velocity needed for 50% of the powder material fed into the gas to bond to the substrate. The critical velocity may depend on the material's physical properties. The critical velocity may also be affected based on the design of the nozzle.

The high velocity that causes powder particles to be deposited on a substrate outside of the cold spray system may also cause deposition of the powder particles inside the nozzle. Because these particles travel at very high speeds while still in the nozzle, they may adhere to the walls of the nozzle or to any design imperfections inside the nozzle. The rate of particle deposition (i.e., residue formation) may be so high that it may either completely or partially block the nozzle to render the system useless or significantly impact the throughput and cost-effectiveness of cold spraying system as a sputtering target preparation technique.

The various embodiment methods and apparatus provide a modified nozzle design which may prevent or reduce deposition of power particles in the in the nozzle of a cold spray system. The inlet geometry of the nozzle may be adjusted to allow the powder particles' stream to focus into a fairly narrow beam in the throat of the nozzle. The exit geometry of the nozzle may also be adjusted to ensure that the broadening of the beam occurs at a slower rate than the expansion of the nozzle. This adjustment of the nozzle's design may be performed in a manner consistent with the particle velocity and temperature goals of the nozzle.

FIG. 1 shows a de Laval (i.e., converging—diverging type) nozzle 15 according to an embodiment. This nozzle 15 contains an inlet portion 15A having a converging inner bore, a throat portion 15B having a smallest size or diameter inner bore and an outlet portion 15C having a diverging inner bore. The inlet portion 15A of the nozzle 15 can be characterized by an inlet diameter $d_{in}$ and an inlet length $L_{in}$. The inlet diameter $d_{in}$ is the inner bore diameter of the nozzle 15 at the gas/powder input end of the inlet portion 15A of the nozzle 15. The inlet length $L_{in}$ may be defined as the length of the nozzle 15 from the gas/powder input portion 15A end to the throat portion 15B. The outlet portion 15C of the nozzle 15 can be characterized by an outlet (or exit) diameter $d_{ex}$ and an output length $L_{ex}$. The outlet diameter $d_{ex}$ is the diameter of the nozzle 15 at the gas/powder output end of the outlet portion 15C of the nozzle 15. The outlet length $L_{ex}$ may be defined as the length of the nozzle 15 from the throat portion 15B to the gas/powder output end portion 15C.

Through computer simulation and experimentation, the inventors have determined that a powder spray nozzle having a ratio of the inlet diameter $d_{in}$ to the inlet length $L_{in}$ in a range of about 0.15 to 0.5 may prevent or reduce deposition of power particles in the in the nozzle of a cold spray system. In an embodiment, the ratio of the inlet diameter to the inlet length is a range of about 0.16 to 0.4. In another embodiment, the ratio of the inlet diameter to the inlet length is a range of about 0.2 to 0.3.

In an embodiment, to reduce or eliminate the residue formation in the nozzle 15, the diameter and length of the nozzle inlet 15A and the overall length of the nozzle 15 may be reduced. These adjustments to the dimensions of the nozzle 15 may allow the particles less time to defuse to the walls inside the nozzle 15 which in turn prevents residue formation inside the nozzle 15.

Simulations

To explore the effect of process and geometry changes on residue build up, a series computational fluid dynamics (CFD) models was created and run. In these models, the inlet diameter $d_{in}$, length $L_{in}$ and pressure were varied. The diameter of the throat $d_{th}$ and nozzle outlet (exit) $d_{ex}$ and well as the outlet length $L_{ex}$ (the length of the expansion region or outlet portion 15C) were not varied. This is because these parameters ($d_{th}$, $d_{ex}$ and $L_{ex}$) are typically fixed by the requirements that the nozzle 15 to achieve a particular Mach number and flow rate. The values of these parameters for the simulations were: throat diameter $d_{th}$=4 mm, output length $L_{ex}$=87 mm and output diameter $d_{ex}$=6 mm). Other suitable dimensions may be used (e.g. throat diameter $d_{th}$=1-12 mm (e.g., 3-12 mm, such as 5-9 mm), output length $L_{ex}$=75-100 mm and outlet diameter $d_{ex}$=3-12 mm). Nozzles with large diameter throats tend to have less material buildup because the surface/volume ratio is less. Thus, the use of a relatively large throat diameter (e.g., a 3 mm or greater diameter, which is greater than a typical prior art nozzle throat diameter of less than 3 mm) in conjunction with the specially designed inlet length and diameter described herein, very sticky powders (e.g., CIG powders) may be cold sprayed with minimal buildup.

To look at the effect of inlet pressure, the center-point of the simulation ($d_{in}$=12 mm, $L_{in}$=45 mm) was also run at 5 bar and 3 bar inlet pressure (runs D10 and D11).

The nozzles 15 were evaluated in terms of the dispersion or spread in the particle spray at the outlet. It was assumed that the larger the spread of the spray, the more likely particles will strike the wall of the nozzle 15 and then stick, leading to the build-up of residue in the nozzle 15. The dispersion was estimated by finding the standard deviation of the spray radius at the outlet. The particle flux data at three angular positions at the outlet were calculated. These three data sets were averaged to determine a flux versus radius and the standard deviation was then calculated with the following equation (1):

$$\text{dispersion} = \sigma = \sqrt{\frac{\int r^2 f(r)dr}{\int f(r)dr}} \qquad \text{(Equation 1)}$$

where f(r) is the flux of particles as a function of radius, r. The lower the dispersion, σ, the lower the expected residual build up in the nozzle 15.

Because of the high flow rates, the air in the nozzle 15 is in the turbulent flow regime. The turbulent dispersion model in the modeling software package (STAR-CCM+) accurately accounted for the effect of this turbulence on the spray dispersion σ. The nozzle 15 was modeled in 3d, as a 45° slice, with symmetry boundary conditions imposed on the two symmetry planes. For all runs, the particle size was set to 20 μm in diameter with the material properties of copper-indium-gallium (CIG). The particle flow rate was set to 1 g/s. Other particle diameters (e.g, 1-100 micron) and flow rates (e.g., 1-10 g/s) may also be sued. The models were first solved for the flow variables (pressure, momentum and temperature). Once a converged solution was obtained, about 10,000 particles were launched from the inlet and their trajectories were determined by the Lagrangian solver built into the software package.

The results of the simulations are summarized in Table 1 below. The worst particle dispersion result was generated in simulation D05. In this model, the dispersion radius was double the next worst simulation, D04. In contrast, simulation D08 produced a dispersion radius that is approximately 13 times smaller than the dispersion radius generated in simulation D08.

TABLE 1

| Case | L_in (mm) | d_in (mm) | P_in (bar) | Dispersion Radius (mm) |
|---|---|---|---|---|
| D01 | 45 | 12 | 8 | 166 |
| D02 | 22.5 | 8 | 8 | 242 |
| D03 | 45 | 8 | 8 | 601 |
| D04 | 22.5 | 12 | 8 | 789 |
| D05 | 22.5 | 16 | 8 | 1555 |
| D06 | 67.5 | 8 | 8 | 764 |
| D07 | 67.5 | 12 | 8 | 435 |
| D08 | 67.5 | 16 | 8 | 112 |
| D09 | 45 | 16 | 8 | 408 |
| D10 | 45 | 12 | 5 | 128 |
| D11 | 45 | 12 | 3 | 117 |

Figure 2:
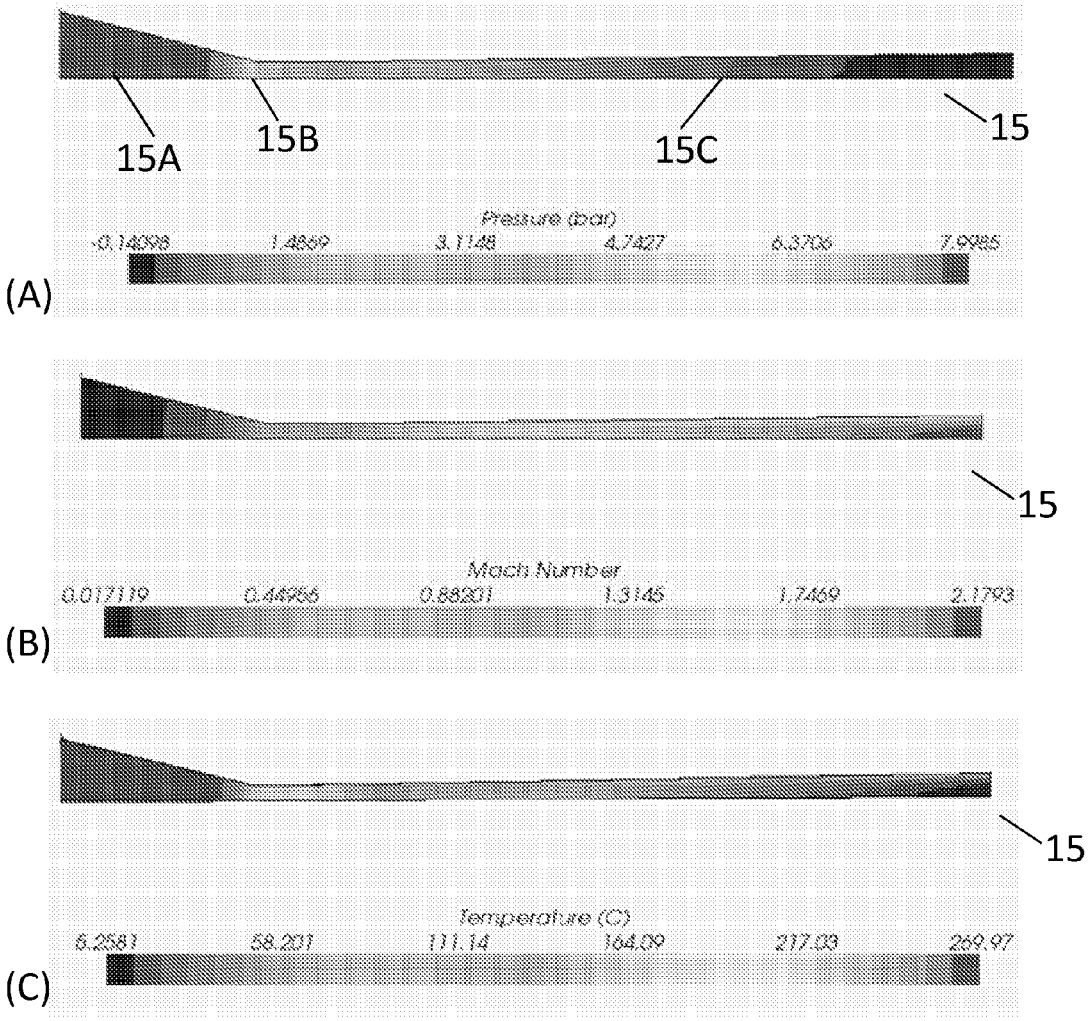
FIG. 2(A) is a simulation illustrating the pressure.
FIG. 2(B) is a simulation illustrating the gas velocity.
FIG. 2(C) is a simulation illustrating the gas temperature of a cold spray nozzle according an embodiment.

The pressure, Mach number and gas temperature for simulation D05 are shown in FIGS. 2A-2C, respectively. These plots show the basic behavior of a converging-diverging nozzle in which the gas accelerates to Mach 1 in the throat, and then accelerates to supersonic speeds in the expansion portion of the nozzle. In this case, the gas speed reaches a velocity of Ma 2.18. This increase in gas velocity comes at the expense of the potential energy (pressure (e.g., approximately 8 bar)) and internal energy (temperature (e.g., approximately 270° C.)) of the gas, both of which decrease significantly. Other velocities (e.g., >1 mach, e.g., 2-3 mach), pressures (e.g., <20 bar, e.g., 2-14 bar, such as 2-8 bar) and temperatures (e.g., 50-280° C., e.g., 100-180° C.) may be used.

Figure 3:
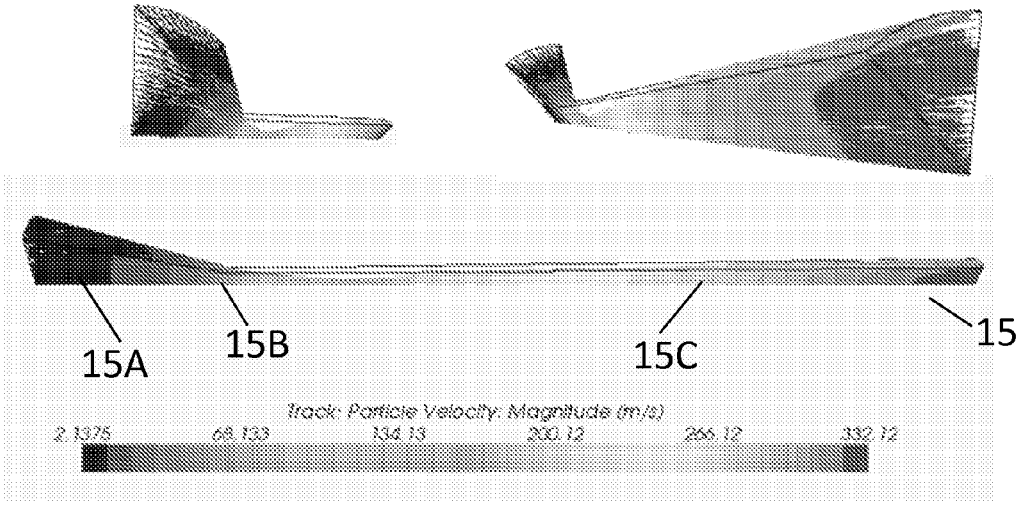
FIG. 3 is a simulation illustrating the particle velocity in the cold spray nozzle of FIG. 2.

The particle streams for simulated nozzle D05 are shown in FIG. 3. The inlet portion 15A focuses the particles as they approach the throat 15B. In the outlet (gas expansion) region 15C, the particles then spread and fill the volume of the exit. This is undesirable from the perspective of a residue buildup on the inner walls of the nozzle 15 as a large number of particles will strike the inner walls of the nozzle 15 before exiting the nozzle.

Figure 5:
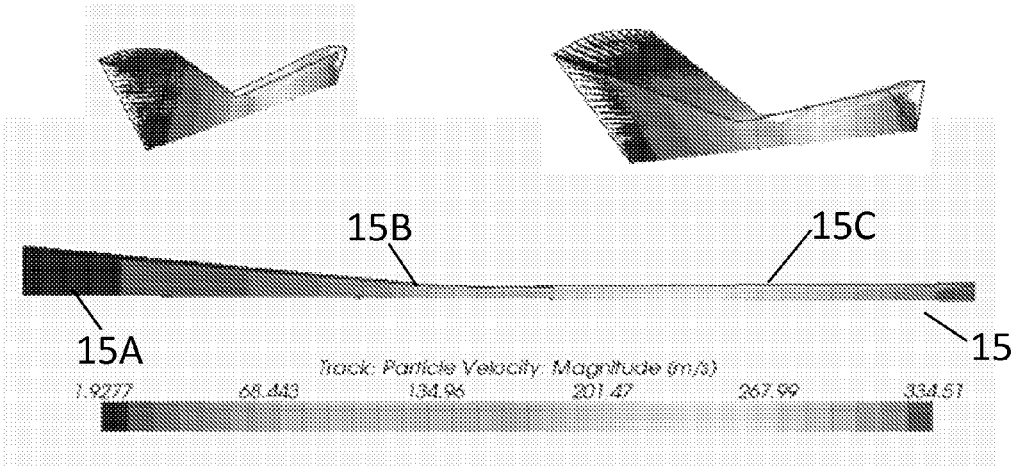
FIG. 5 is a simulation illustrating the particle velocity in the cold spray nozzle of FIG. 4.
Figure 4:
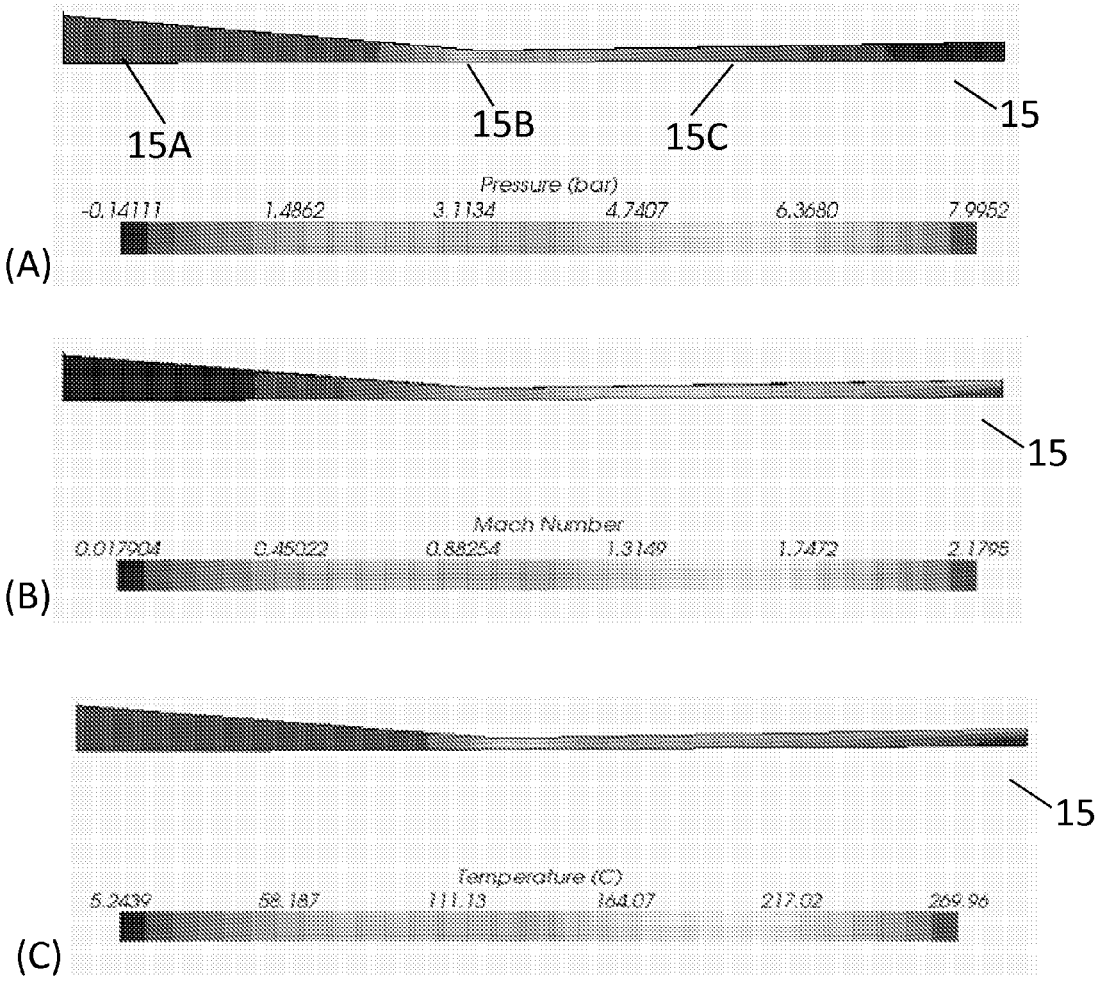
FIG. 4(A) is a simulation illustrating the pressure.
FIG. 4(B) is a simulation illustrating the gas velocity.
FIG. 4(C) is a simulation illustrating the gas temperature of a cold spray nozzle according another embodiment.

FIGS. 4A-4C show the pressure, Mach number and gas temperature for simulation D08. These properties, as expected, are similar to those of simulation D05. This is in contrast to the particle dispersion results for the two simulations. The particle dispersion for simulation D08 can be seen in the particle plot in FIG. 5. In this case, the particle stream is much more tightly packed. Because the particle stream is more tightly packed, a lower residue is formed on the walls of the nozzle 15.

Figure 6A:
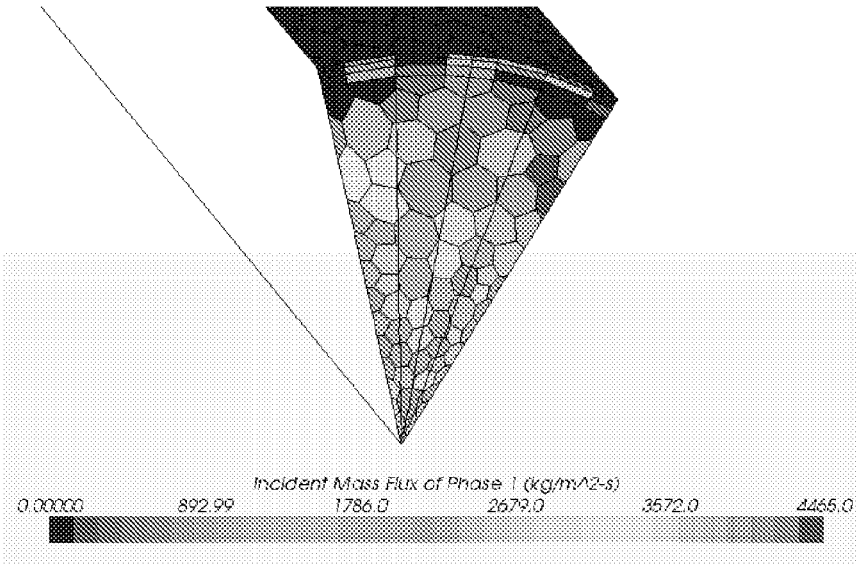
FIG. 6(A) is a simulation illustrating the particle flux at the exit for the cold spray nozzle of FIG. 2.
Figure 6B:
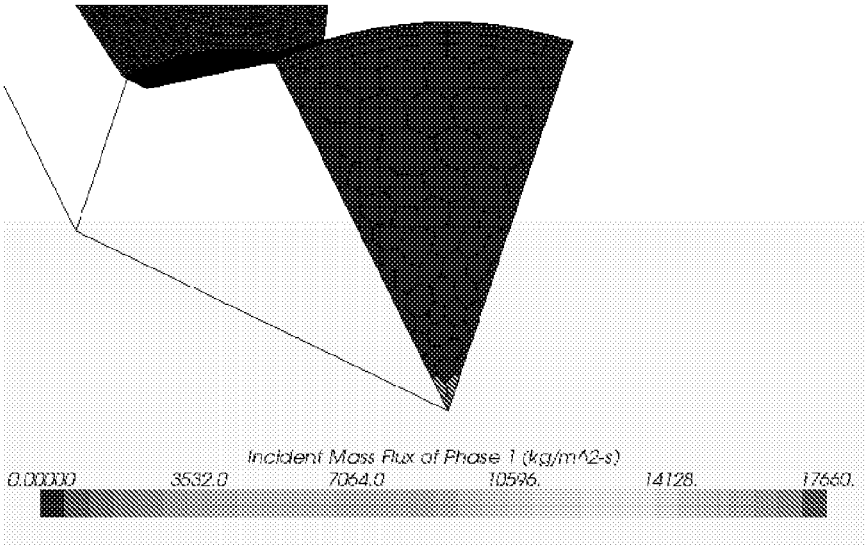
FIG. 6(B) is a simulation illustrating the particle flux at the exit for the cold spray nozzle of FIG. 4.

FIGS. 6A and 6B illustrate another way to compare simulations D05 and D08. FIGS. 6A (simulation D05) and 6B (simulation D08) plot the particle flux at the exit of the respective, nozzles 15. For the D05 case, the particle flux substantially covers the entire exit area. For the D08 case, the flux is concentrated at the center of the nozzle 15.

Figure 7:
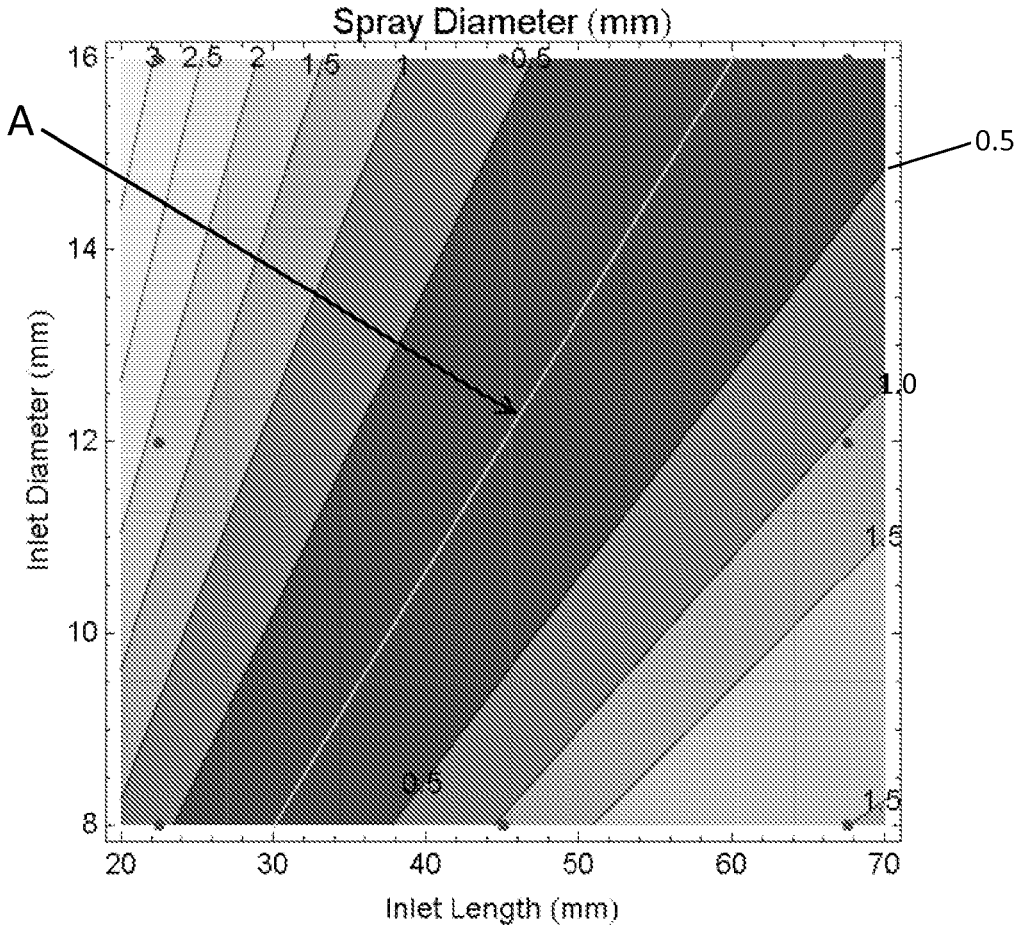
FIG. 7 is a contour plot of the dispersion function for simulated cold spray nozzles according to embodiments.

FIG. 7 illustrates another method of comparing the results of the simulations summarized in Table 1. To generate FIG. 7, the results in Table 1 were first fitted with a mathematical model. In this embodiment, a polynomial in the input variables was used for fitting. That is, the data was fitted using a polynomial using the aspect ratio ($d_{in}/L_{in}$) of the nozzle inlet 15A. This function is, $$\text{dispersion} = A + B\frac{d_{in}}{L_{in}} + C\left(\frac{d_{in}}{L_{in}}\right)^2 + D\left(\frac{d_{in}}{L_{in}}\right)^3 \quad \text{(Equation 2)}$$

The best fit of the data in Table 1 was found with A=4194.3, B=−2606.6, C=520.60 and D=−30.80. This expression is plotted in FIG. 7. The lines sloping from left to right in FIG. 7 are lines of constant spray diameter. Because the dispersion is based on the radius (Equation 1) of the nozzle 15, the spray diameter is twice the dispersion. Further, the spray diameter may be defined as the diameter of the area which includes 90% of the particles. FIG. 7 illustrates a valley running from lower left to upper right. This valley defines the region where the particle spray is the narrowest and minimal residue is expected on the inner walls of the nozzle 15. The bottom of the valley, shown by the line (A), is approximated by:

$$L_{in} = \frac{15}{4}d_{in}$$

The above expression in conjunction with FIG. 7 provides guidance for designing a nozzle to have minimum residue in the inside of the nozzle 15. For example, powder spray nozzle having a ratio of the inlet diameter $d_{in}$ to the inlet length $L_{in}$ in a range of about 0.15 to 0.5 may prevent or reduce deposition of power particles in the in the nozzle of a cold spray system. In an embodiment, the ratio of the inlet diameter to the inlet length is in a range of about 0.16 to 0.4. In another embodiment, the ratio of the inlet diameter to the inlet length is in a range of about 0.2 to 0.3.

In an embodiment, nozzle 15 produces a powder spray diameter less than or equal to 6 mm. In another embodiment, the nozzle produces a spray diameter less than or equal to 4 mm. In still another embodiment, the nozzle produces a spray diameter less than or equal to 2 mm, such as 0.23 to 1 mm, for example 0.25-0.5 mm.

In an embodiment, the nozzle produces a spray diameter less than or equal to one quarter of the outlet portion 15C inner bore diameter. In another embodiment, the nozzle produces a spray diameter less than or equal to one sixth of the outlet diameter. In still another embodiment, the nozzle produces a spray diameter less than or equal to one twelfth of the outlet diameter.

In an embodiment, the exit velocity of a gas in the nozzle is greater than Mach 1 (e.g., Mach 2-3). The spray nozzle may be converging-diverging nozzle or a converging nozzle with a non-diverging outlet portion 15C. In an embodiment, the inlet length $L_{in}$ is between 20 and 70 mm (e.g., 45-68 mm) and the inlet diameter $d_{in}$ is between 8 and 25 mm (e.g., 8-16 mm).

Figure 8:
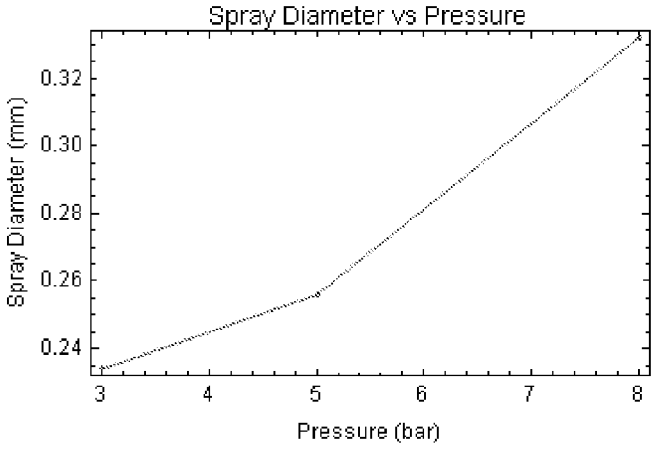
FIG. 8 is a plot illustrating the effect of pressure on the particle dispersion.

The last rows of Table 1 (simulations D10 and D11) show the effect of inlet pressure on particle dispersion. As illustrated in FIG. 8, there is a small increase in dispersion with pressure. Without being bound by any particular theory, the inventors believe that the increase in dispersion is due to increased turbulence at the higher pressures, due to the higher flow rate. The higher turbulence results in a higher Reynolds number.

Figure 9:
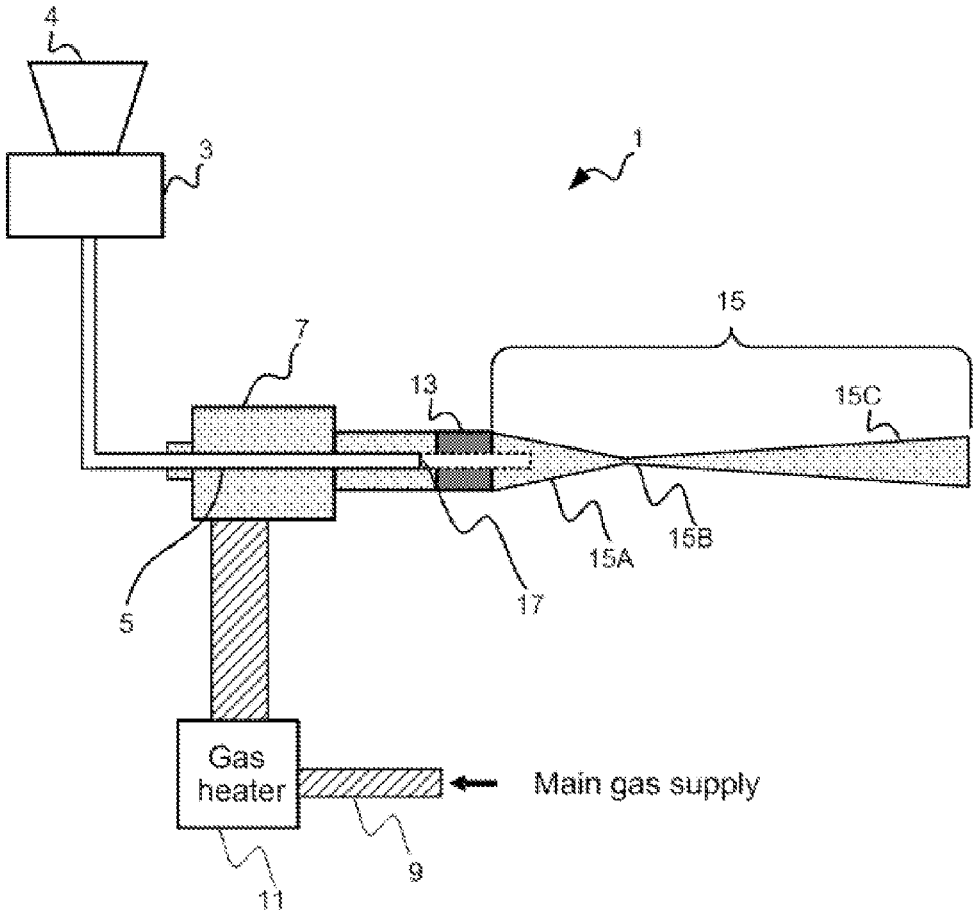
FIG. 9 is a schematic illustration of a cold spray system according to an embodiment.

FIG. 9 is a schematic illustration of an exemplary cold or kinetic spray deposition system 1 according to an embodiment. The system 1 includes a powder feed unit 3. The powder feed unit 3 may include a hopper 4 for receiving the powder and optionally a mechanical feeder (not shown), such as screw feeder, or a non-mechanical feeder (not shown), such as a fluidized bed. Alternatively, the powder may simply be fed downward by gravity from the hopper 4 if the powder feed unit 3 is located at a top of the system 1. Preferably, the power feed unit 3 has non stick surfaces and pressure on powder is preferably avoided. The system 1 may also include a powder feed line 5, such as a pipe, tube or other conduit which operatively connects the powder feed unit 3 to a spray gun 7. The term "operatively connects" means either a direct or an indirect but functional connection. Any suitable spray gun 7 known in the cold or kinetic spray art may be used.

The system also contains a process gas supply conduit 9, such as a gas inlet pipe or tube. The supply conduit 9 may include a blower if needed. The process gas supply conduit 9 is operatively connected to the spray gun 7. A process gas heater 11, such as a resistive, lamp or other heater type is positioned to heat the process gas in the process gas supply conduit 9. Thus, the heater 11 may be located on, in or around the process gas supply conduit 9 to preheat the process gas to the desired process temperature. If desired, an unheated process gas may be provided into the powder feed unit 3 to assist movement of the powder through the line 5. In an embodiment, the process is heated to a temperature between 50 and 280° C., such as to a temperature between 100 and 180° C. In an embodiment, the process gas is supplied at a pressure of 20 bar or less, such as at a pressure of 2 to 14 bar, for example at a pressure of 2 to 8 bar.

An optional pre-chamber or mixing chamber 13 may be located between the spray gun 7 and the nozzle 15. Thus, the nozzle 15 is operatively connected to the spray gun 7. In other words, the nozzle 15 may be directly connected to the spray gun 7 or the nozzle may be indirectly connected to the spray gun in the case where the pre-chamber 13 is located between the spray gun and the nozzle. The nozzle 15 preferably includes a converging bore in an inlet portion and diverging bore in an outlet portion, as described above.

In the cold spray process, kinetic energy is transferred from a high velocity gas stream to the powder that is used to create the deposit. The gas density rapidly decreases in the standard supersonic nozzles and larger particles and smaller particles have greatly differing exit velocities due to inertia. Residence time of the powder in the gas stream is usually very short, not allowing considerable particle warming or heating.

In one embodiment, the spray deposition system 1 includes a powder feed unit 3 and a spray gun 7 operatively connected to the powder feed unit 3. The spray gun 7 includes a nozzle 15. A ratio of the inlet diameter $d_{in}$ to the inlet length $L_{in}$ of the nozzle 15 is a range of about 0.15 to 0.5. The system also includes a process gas supply 9 operatively connected to the spray gun 7. The gas supply is configured to provide a process gas to the spray gun 7. In an embodiment, the system 1 provides sufficient kinetic energy for cold spray powder deposition. In an embodiment the nozzle 15 of the spray gun 7 is a converging-diverging nozzle.

In one embodiment, the system 1 is designed such that the powder particles have a longer residence time in the heated process gas. This is done by adding the pre-chamber (also referred to as a mixing chamber or powder feed line heating section) 13. The powder feed line 5 and the process gas supply conduit 9 may be positioned in the pre-chamber 13 to allow heat transfer between them. Thus, the pre-heated process gas is used to pre-heat the powder in the powder feed line 5 before the heated gas and the powder are mixed. For example, the process gas supply conduit 9 may be located concentrically around the powder feed line 5 in the pre-chamber 13 as shown in FIG. 9. In other words, the powder feed line 5 may be located inside the process gas supply conduit 9. Alternatively, the powder feed line 5 and process gas supply conduit 9 can be located adjacent to each other to allow heat transfer between them (i.e., in direct physical contact or in sufficient proximity to allow convective heat transfer). For example, the powder feed line 5 and process gas supply conduit 9 may share a common wall for heat transfer.

The pre-chamber 13 length may be for example 5-250 mm, such as 50-200 mm or preferably 75-150 mm, and can be optimized based on the process gas, powder material and other process variables to facilitate heating of the powder. The powder feed line 5 extends into (and optionally through) the pre-chamber 13 such that the powder located in the powder feed line 5 is heated by a hot or warm process gas in the process gas supply conduit 9 before the powder is provided into the heated process gas (i.e., before the powder is mixed with any process gas). The pre-chamber 13 is illustrated in FIG. 9 as having a variable length. As shown in FIG. 9, the powder injection point 17 may vary along the length of the powder feed line 5. Thus, the injection point 17 may be located at any point along the powder feed line 5 section that is shown in dotted lines.

In an embodiment, the powder comprises a copper indium gallium (CIG) alloy and the powder is sprayed onto a substrate comprising a sputtering target support. In an embodiment, the sputtering target support comprises a cylindrical support for a rotary sputtering target and the powder forms a copper indium gallium sputtering layer deposited on an outer surface of the cylindrical support. Preferably, the CIG powder has a composition of about 29-41 wt %, such as 29-39 wt % copper, about 36-62 wt %, such as 49-62 wt % indium, and about 8-25 wt %, such as 8-16 wt % gallium. In another embodiment, the CIG powder has a composition of about 8-15 wt % copper, about 55-80 wt % indium, and about 10-25 wt % gallium. Preferably, the powder has an overall uniform composition, whereby the wt % of each of these 3 primary elements, of samples taken from any 2 random locations of the powder, as determined by reliable analytical procedures of a material volume of at least 10 $mm^3$, does not vary relatively by more than 10%, and more preferably not more than 5%.

The preceding description of the disclosed embodiments is provided to enable any person skilled in the art to make or use the present invention. Various modifications to these embodiments will be readily apparent to those skilled in the art, and the generic principles defined herein may be applied to other aspects without departing from the scope of the invention. Thus, the present invention is not intended to be limited to the aspects shown, the examples described and illustrations herein, but is to be accorded the widest scope consistent with the following claims and the principles and novel features disclosed herein.

What is claimed is:

1. A method of using a powder spray nozzle comprising:

spraying a powder onto a substrate through a nozzle; and supplying a process gas heated to a temperature between 50 and 280° C. from a process gas supply through the nozzle together with the powder, wherein the nozzle comprises:

an inlet portion having an inlet diameter and an inlet length;

an outlet portion having outlet diameter and an outlet length; and an interface region between the inlet portion and the outlet portion having an interface diameter, wherein a ratio of the inlet diameter to the inlet length is a range of about 0.15 to 0.5.

2. The method of claim 1, wherein the powder comprises a metal or metal alloy powder which flows through the nozzle in a turbulent flow regime.

3. The method of claim 1, wherein the temperature of the heated process gas is between 100 and 180° C.

4. The method of claim 1, wherein an exit velocity of the process gas from the nozzle is greater than mach 1.

5. The method of claim 1, wherein the process gas is supplied at a pressure of less than 20 bar.

6. The method of claim 1, wherein the process gas is supplied at a pressure of 2 to 14 bar and wherein the powder comprises a copper indium gallium alloy.

7. The method of claim 6, wherein the process gas is supplied at a pressure of 2 to 8 bar.

8. The method of claim 1, wherein the powder comprises a copper indium gallium alloy and the substrate comprises a sputtering target support.

9. The method of claim 8, wherein the sputtering target support comprises a cylindrical support for a rotary sputtering target and the powder forms a copper indium gallium sputtering layer deposited on an outer surface of the cylindrical support.

10. The method of claim 8, wherein the sputtering target support comprises a cylindrical support for a rotary sputtering target and the powder forms a copper indium gallium sputtering layer deposited on an outer surface of the cylindrical support, and wherein a throat diameter of the nozzle is between 3 and 12 mm.

11. The method of claim 1, further comprising mixing the process gas heated to the temperature between 50 and 280° C. with the powder prior to the step of providing the process gas through the nozzle together with the powder.

12. The method of claim 6, wherein the process gas consists essentially of air.

13. The method of claim 1, wherein the process gas consists essentially of air.

14. The method of claim 1, wherein the process gas substantially excludes helium.

* * * * *